United States Patent [19]

Clem

[11] Patent Number: 4,997,701

[45] Date of Patent: Mar. 5, 1991

[54] SEAWATER RESISTANT CLAY MIXTURE

[75] Inventor: Arthur J. Clem, Chicago, Ill.

[73] Assignee: James Clem Corporation, Chicago, Ill.

[21] Appl. No.: 274,166

[22] Filed: Nov. 21, 1988

[51] Int. Cl.[5] ..... B32B 19/06; E02D 27/32

[52] U.S. Cl. ..... 428/241; 52/169.14; 106/33; 106/900; 405/19; 405/270; 428/72; 428/76; 428/102; 428/242; 428/248; 428/252; 428/283; 428/325; 428/454; 428/906; 428/911; 428/913

[58] Field of Search ..... 52/169.14; 405/19, 270; 428/72, 76, 102, 241, 242, 248, 283, 325, 454

[56] References Cited

U.S. PATENT DOCUMENTS

| | | | |
|---|---|---|---|
| 3,186,896 | 5/1962 | Clem . | |
| 4,005,582 | 8/1975 | Tamaro | 61/35 |
| 4,048,373 | 10/1975 | Clem | 428/454 |
| 4,055,937 | 7/1976 | Tamaro | 52/577 |
| 4,056,154 | 7/1976 | Tamaro | 175/416 |
| 4,075,852 | 7/1976 | Tamaro | 61/35 |
| 4,103,499 | 5/1977 | Clem | 61/50 |
| 4,139,588 | 3/1978 | Clem | 264/232 |
| 4,209,568 | 6/1980 | Clem | 428/454 |
| 4,467,015 | 11/1981 | Clem | 428/454 |
| 4,501,788 | 9/1982 | Clem | 428/240 |

OTHER PUBLICATIONS

Civil Engineering, Slurry Trenches for Containing Hazardous Wastes, 02/84.

Specdata, Waterproofing, 06/87.

Specdata, Ponds and Reservoirs, 11/87.

Enviromat/Fw, Below-Grade Bentonite Waterproofing, 07/87.

Enviromat, Liquid Containment Liner, 07/87.

IMC Corp., Bentonite for Civil Engineering Applications, 08/83.

*Primary Examiner*—James C. Cannon

*Attorney, Agent, or Firm*—Baker & McKenzie

[57] ABSTRACT

A mixture of swellable clay, such as bentonite, is charged with an additive which provides an excess of univalent ions which tend to neutralize the deleterious effects of ions which are naturally present in seawater. The mixture is deposited on and carried by a sheet to facilitate its uses as a pond liner or a foundation sealant.

5 Claims, No Drawings

SEAWATER RESISTANT CLAY MIXTURE

BACKGROUND AND SUMMARY OF THE INVENTION

The present invention relates to a mixture for use in making a sheet of clay which restricts the flow of seawater.

Bentonite is a particularly well-suited clay for use in sheets of the present invention. When wetted, bentonite swells, or hydrates, by absorbing films of water that are thicker than those which form on other clays. The water absorbed by bentonite is retained even when subjected to high pressures. Bentonite is capable of swelling as much as ten to fifteen times its dry volume, and can absorb water to almost five times its own dry weight, while retaining its impermeability.

A very important characteristic of bentonite is that it will swell when uncontained, but will not exert significant pressure when confined against further swelling.

Various references which acknowledge that swellable clay is generally suitable to form water impervious layers in a soil structure. Furthermore, a series of patents issued to Arthur G. Clem, i.e. U.S. Pat. Nos. 4,048,373; 4,103,499; 4,139,588; 4,467,015, suggest that a combination of additives is "absolutely necessary" for the proper performance of a bentonite layer in a seawater environment. The combination which is said to be essential includes a water-soluble dispersant, and a water-soluble polymer. An exemplary dispersant is said to be a salt of phosphoric acid. Alternative dispersants suggested in the Clem patents include salts of alkaline earth metals. An example of the other essential element mentioned in the Clem patents is polyacrylic acid. There is no explanation of the theory behind the selection of these "essential" components of the mixture.

It is believed that the contaminating effects of seawater upon the swellability of a bentonite layer is due to the presence of bivalent ions, such as calcium ions. It is understood that bentonite forms a multi-layer crystalline structure in the presence of water, and in the presence of pure water its ability to swell is at a maximum. However, in the presence of seawater, which may contain various concentrations of contaminants, the ability of the bentonite to form a crystalline structure of maximum volume is inhibited. It is believed that the calcium ions which are contained in seawater have a very significant effect on the ability of bentonite to form a proper crystalline structure It has been found that by significantly increasing the ratio of univalent ions, such as sodium ions, to the number of bivalent ions, such as calcium ions, the ability of bentonite to swell in the presence of seawater can be improved.

Furthermore, contrary to the teachings of Clem, as discussed above, it has been found that the presence of a water-soluble polymer is not essential to the formation of a mixture which will resist the detrimental effects of seawater.

U.S. Pat. No. 4,501,788 (the '788 patent), which is assigned to the assignee of the present invention, shows a particularly useful form in which the mixture of the present invention can be used. The '788 patent describes a flexible sheet comprising a support coated with a swellable bentonite. The support is a porous flexible layer of fabric. Such sheets are used to line ponds and lagoons and landfills, tank farms and hazardous waste sites. By using a sheet of swellable bentonite, an impervious layer is formed to prevent hazardous leachate from entering adjacent groundwater systems.

An important object of this invention is to provide an inexpensive and effective barrier to the flow of seawater through a soil structure or foundation.

Accordingly, a further object is to provide a mixture comprised of the minimum number of components necessary to resist the degradation of the clay layer by seawater.

Still another object of the present invention is to enhance the seawater resistance of sodium bentonite clay with the addition of univalent ions, which will tend to neutralize the contaminative effects of multivalent ions in the seawater.

These and other objects of the present invention will be apparent from the following detailed description of an embodiment of the invention.

DETAILED DESCRIPTION OF THE INVENTION

An effective mixture in accordance with the present invention consists of powdered, dehydrated bentonite, modified by the addition of trisodium polyphosphate, where the additive is combined with bentonite at a rate of ten (10) lbs. of additive per 2000 lbs. of bentonite The components are preferably mixed thoroughly in either a batch or continuous process, and subsequently formed into a flexible sheet with the mixture sandwiched between two fabrics, at least one of which is fluid permeable. The chemicals may be dissolved in water, then added to the bentonite or bentonite added to the chemical solution, followed by drying. The preferred thickness for the combined total is approximately $\frac{1}{4}$ inch, yielding a sheet having approximately 1 lb. of bentonite per square foot. It is recommended that the weight of trisodium polyphosphate not exceed 40 lbs. per 2000 lbs. (or 2%) of bentonite and that the weight of trisodium polyphosphate be at least 1 lb. per 2000 lbs. (or 0.05%) of bentonite. This range of ratios has been selected to resist the contaminative effects of typical coastal seawater.

Trisodium polyphosphate and bentonite are mixed and made into a sheet by the following process. Naturally mined bentonite is made into a powder and thoroughly dehydrated by baking. A large quantity of dehydrated bentonite is placed in a hopper along with a required amount of trisodium polyphosphate and mixed thoroughly. A thin layer of the resulting mixture is placed on a first geotextile or carrier. The carrier is preferably a permeable sheet made of polypropylene, polyester, jute or nylon. The carrier may be woven or perforated to make it permeable to liquids and gases. A woven material is preferred so that a larger surface area is provided to which the modified bentonite mixture may adhere. However, an impervious carrier may be appropriate in some instances.

After depositing the modified bentonite o the carrier material, a cover layer is placed over the bentonite layer. The cover layer is preferably a lightweight textile or textile-like material which is preferably highly fluid permeable. The purpose of the cover layer is to separate the bentonite layers in a rolled condition and to assist in keeping the sheet in a unitary or composite condition during the handling and placement of the sheet. Means for maintaining the internal integrity of the clay mass of the sheet includes some kind of adhesive or binder, which may be a fibrous material containing a substantial amount of cellulose, and needling of the clay to insure its retention by the fabric.

The strength of the carrier must be such that when rolled up with the layer of modified bentonite, it can withstand transportation to remote areas by any of several means of transport, such as fork lifts, cranes, trucks, boats, etc., and so that it can withstand rough handling by construction workers and delivery personnel.

Sources of univalent ions which can be used in accordance with this invention include any of the family of sodium salts of polyphosphoric acids, for example, molecularly dehydrated sodium phosphates, such as, but not limited to sodium tripolyphosphate, tetra-sodium pyrophosphate, sodium acid pyrophosphate, sodium hexameta phosphate and the like, which can be added to bentonite in the same amounts as trisodium polyphosphate. These products are made by reacting phosphoric acid with an alkali such as sodium carbonate or sodium hydroxide, applying heat to expel water until the salt melts, then cooling rapidly into a glass. The composition of the molten salt can be controlled by the amount of alkali used to react with the phosphoric acid.

Accordingly, it is intended that the scope of the invention be limited not by the specific, illustrated example, but rather by the scope of the appended claims interpreted in light of the pertinent prior art.

We claim:

1. A flexible sheet for use in restricting the flow of seawater comprising:

a layer of water swellable clay in admixture with an additive for enhancing the resistance to seawater and the swellability in the presence of seawater of said water-swellable clay, said layer being carried by at least one geotextile, said additive being one which upon exposure to seawater forms a substantial number of univalent ions capable of neutralizing the deleterious effects of multivalent ions in the seawater, said layer having no water-soluble polymer.

2. A flexible sheet in accordance with claim 1 wherein said water-swellable clay is sodium bentonite.

3. A flexible sheet in accordance with claim 2 wherein said univalent ions are sodium ions.

4. A flexible sheet in accordance with claim 1 wherein said geotextile is a material selected from polypropylene, polyester, jute, and nylon.

5. A flexible sheet in accordance with claim 1 wherein said means is an additive selected from the family of sodium salts of polyphosphoric acid.

* * * * *